United States Patent [19]

Koishi et al.

[11] Patent Number: 4,947,031

[45] Date of Patent: Aug. 7, 1990

[54] SAMPLING STREAK TUBE WITH ACCELERATING ELECTRODE PLATE HAVING AN OPENING

[75] Inventors: Musubu Koishi; Yutaka Tsuchiya; Katsuyuki Kinoshita; Yoshinori Inagaki, all of Shizuoka, Japan

[73] Assignee: Hamamatsu Photonics Kabushiki Kaisha, Shizuoka, Japan

[21] Appl. No.: 291,893

[22] Filed: Dec. 29, 1988

[51] Int. Cl.[5] ..... H01J 31/50

[52] U.S. Cl. ..... 250/213 VT; 313/529

[58] Field of Search ..... 250/213 VT; 313/529, 313/537, 103 CM, 105 CM

[56] References Cited

U.S. PATENT DOCUMENTS

| | | | |
|---|---|---|---|
| 4,012,657 | 3/1977 | Loty | 250/213 VT |
| 4,645,918 | 2/1987 | Tsuchiya et al. | 250/213 VT |
| 4,694,154 | 9/1987 | Tsuchiya et al. | 250/213 VT |
| 4,740,684 | 4/1988 | Tsuchiya | 250/213 VT |
| 4,801,796 | 1/1989 | Kinoshita | 313/529 |

FOREIGN PATENT DOCUMENTS

| | | |
|---|---|---|
| 55-29787 | 3/1980 | Japan . |
| 1189474 | 4/1970 | United Kingdom . |
| 1514339 | 6/1978 | United Kingdom . |
| 1541883 | 3/1979 | United Kingdom . |
| 2065964A | 7/1981 | United Kingdom . |
| 2133875A | 8/1984 | United Kingdom . |
| 2133875B | 5/1986 | United Kingdom . |
| 2172991A | 10/1986 | United Kingdom . |

OTHER PUBLICATIONS

Tsuchiya, Y. et al., "High Speed Photography, Videography, and Photonics V", Proceedings of the SPIE, vol. 832, pp. 227–234, Aug. 1987.

*Primary Examiner*—David C. Nelms
*Assistant Examiner*—Sherrie Hsia
*Attorney, Agent, or Firm*—Finnegan, Henderson, Farabow, Garrett, and Dunner

[57] ABSTRACT

A sampling streak tube in which the signal-to-noise ratio is reduced. The tube includes a photocathode to which an incident light beam is applied and an accelerating electrode for accelerating an electron beam emitted by the photocathode the accelerating electrode being in the form of a plate with an opening through which the beam passes. The accelerated beam is passed through deflecting electrodes for deflecting the electron beam. The deflected beam crosses a slit in a sampling electrode, a sampled beam portion passing through the slit and impinging on a phosphor screen.

15 Claims, 12 Drawing Sheets

SAMPLING STREAK TUBE WITH ACCELERATING ELECTRODE PLATE HAVING AN OPENING

BACKGROUND OF THE INVENTION

1. Field of the Invention

The invention relates to optical waveform observing apparatus for observing the waveform of an optical pulse having a predetermined repetitive frequency.

2. Description of the Prior Art

One example of conventional means for observing the waveform of an optical pulse having a certain repetitive frequency uses a streak tube used to convert the variation with time of an optical pulse into a luminance distribution, such as a streak image on a phosphor screen.

FIG. 10 is a block diagram showing the arrangement of conventional optical waveform observing apparatus as disclosed in U.S. Pat. No. 4,645,918. In that apparatus, a hematoporphyrin derivative 104 is repetitively excited with a pulsed light beam repetitively outputted by a dye laser oscillator 101, to emit fluorescence, the waveform of which is observed with a streak tube 130. Streak tube 130, as shown in FIG. 10, comprises a photocathode 131 to which fluorescence is applied, an accelerating electrode 135 for accelerating the electron beam output by the photocathode 131, a focusing electrode 136 for focusing the electron beam accelerated by the accelerating electrode 135, an aperture electrode 137, deflecting electrodes 133 for deflecting in a sweep mode the forward electron beam after it passes through the aperture electrode 137, a microchannel plate 132 for multiplying the deflected electron beam and a phosphor screen 134 for receiving the output electron beam of the microchannel plate 132.

The pulsed light beam repetitively outputted by the dye laser oscillator 101 is divided into two pulsed light beams by a beam splitter 102. One of the two pulsed light beams excites the hematoporphyrin derivative 104 repetitively. The fluorescence emitted by derivative 104 is applied through an optical system 116 to the photocathode 131 of the streak tube 130 at a certain repetitive frequency. The other pulsed light beam is applied to a photodiode 105 to form an electrical signal TR for a predetermined deflecting voltage that is applied to deflecting electrodes 133 in streak tube 130. More specifically, the pulsed light beam is subjected to photo-electric conversion by the photodiode 105 to form the electrical signal TR. The electrical signal TR, being delayed by a time sweep circuit 107 under the control of a control unit 110, is converted into a deflecting trigger signal that is applied to a deflecting circuit 108. Circuit 108 in turn produces a deflecting voltage in synchronism with the deflecting trigger signal.

With respect to the streak tube 130, the output electron beam of the photocathode 131 is deflected by the deflecting voltage applied across the deflecting electrodes 133 in the sweep mode, so that the variation with time of the fluorescence applied to the photocathode 131 is converted into a spatial luminance distribution on the phosphor screen 134, i.e., it is observed as a streak image. In the optical waveform observing apparatus of FIG. 10, the light of the luminance distribution on phosphor screen 134, i.e., the light of the streak image, is applied through a lens 118 to a sampling board 111 with a slit 109, so that it is sampled by slit 109 to provide a sampling waveform. The sampling waveform is applied to a photomultiplier 112 that subjects it to photo-electric conversion and multiplication. The output of the photo-multiplier 112 is applied through an amplifier 113 to a display unit 114.

The operation of the optical waveform observing apparatus thus organized will be described with reference to FIG. 11 which is a time chart.

In response to the pulsed light beam repetitively outputted by the dye laser oscillator 101, the hematoporphyrin derivative outputs fluorescence with a repetitive period. This is indicated in part (a) of FIG. 11 which shows the waveform of an incident light beam "IN", which is applied to the photocathode 131 of the streak tube 130. Also in response to the pulsed light beam of dye laser oscillator 101, the photodiode 105 outputs the electrical trigger signal TR a shown in part (b) of FIG. 11. As is apparent from parts (a) and (b) of FIG. 11, the electrical trigger signal TR is completely synchronized with the incident light beam IN. The electrical trigger signal TR is gradually delayed by time sweep circuit 107 as shown in part (c) of FIG. 11, thus being converted into the deflecting trigger signal. As shown in part (c) of FIG. 11, at the n-th sampling time, the deflecting trigger signal TR1 is delayed by a period of time n.t from the trigger signal TR; at the (n+1)-th sampling time, the deflecting trigger signal TR2 is delayed by a period of time (n+1) t; at the (n+2)-th sampling time, the deflecting trigger signal TR3 is delayed by a period of time (n+2).t; and so forth, where t is the unitary delay time of the deflecting trigger signal.

When the deflecting trigger signals are applied to deflecting circuit 108, the latter produces the deflecting voltage V as shown in part (d) of FIG. 11. As seen in part (d) of FIG. 11, the deflecting voltage V is maintained at a potential $V_m$ when it is not used to deflect the output electron beam of the photocathode 131. However, when the deflecting trigger signal is applied to deflecting circuit 108, the deflecting voltage drops to a potential $-V_m$ substantially with a ramp characteristic, to deflect the electron beam. Whenever the deflecting voltage is decreased in the above-described manner, the electron beam is deflected downwardly, as a result of which it is observed as streak images FG1, FG2, FG3, . . . at the sampling times as shown in part (e) of FIG. 11. As a result, the variation in intensity of the incident light beam IN can be observed as a luminance distribution.

As seen from parts (a) and (e) of FIG. 11, the streak images FG1, FG2, FG3, reflect the respective incident light beams IN. However, the streak images are shifted in phase from one another because the deflecting voltages at the sampling times are shifted in phase from one another. When, during the electron beam deflecting operation, the deflecting voltage is near zero (0) volts, the electron beam reaches the central portion and emits a light beam at the central portion of the phosphor screen. Most of the light beam reached passes through the slit 109 of the sampling board 111, so that it is detected as a sampling signal by the photomultiplier 112. Referring to part (e) of FIG. 11, at the respective n-th, (n+1)-th and (n+2)-th sampling times, sampling signals P1, P2 and P3 are extracted by slit 109 of sampling board 111, so that the light beam is detected as a sampling signal by the photomultiplier 112.

The sampling signals Pl, P2, P3, . . . are detected in a time-series mode and arranged, as a result of which the pulse waveform of the incident light beam "IN" can be observed with a predetermined time resolution.

In the case of FIG. 10, the sampling board 111 with the slit 109 is provided outside of the streak tube 130. However, as shown in FIG. 12, the sampling board may be provided inside the streak tube. That is, the sampling board may be arranged between the microchannel plate 132 and the phosphor screen 134. In the streak tube 150 shown in FIG. 12, a sampling electrode 151 is provided therein and held at the same potential as the phosphor screen 134. The streak tube having the sampling electrode mounted inside is generally referred to as "a sampling streak tube". With respect to the sampling streak tube, the sampling waveform can be extracted before the electron beam reaches the phosphor screen 134. Therefore, unlike the apparatus shown in FIG. 10 in which the electron beam is applied to the phosphor screen 134 throughout the whole sweep period, in an optical waveform observing apparatus including the sampling streak tube, the necessary electron beam is applied only to the central portion of phosphor screen 134, and only a part of the luminance distribution is applied to the photomultiplier 112. As a result, the sampling waveforms detected are less affected by the background noises of the phosphor screen.

In the streak tube 130 shown in FIG. 10 or in sampling streak tube 150 shown in FIG. 12, the accelerating electrode 135 is a circular mesh accelerating electrode and therefore, the electron beam passing through the accelerating electrode 135 includes background noises. The mesh opening percentage of the accelerating electrode 135 is generally 60%. As shown in part (a) of FIG. 13, about 40% of the incident light beam which, not being subjected to photoelectric conversion by the photocathode 131, has passed therethrough, is scattered by the mesh material, thus forming scattered light beams DF. The scattered light beams DF are applied to the photocathode 131 from behind, thus causing the photocathode 131 to emit photoelectrons BG that represent the background noises. Part (b) of FIG. 13 shows the density distribution of the electrons that reach the sampling electrode 151 in the streak tube 150. As is apparent from part (b) of FIG. 13, in the case where the accelerating electrode 135 is a mesh electrode, the electron density distribution $\rho$ includes a signal electron density distribution $\rho_o$ and a scattered light beam photoelectron density distribution $\rho_e$. The latter density distribution $\rho_e$ represents the background noises and lowers the sampling waveform observation accuracy. As seen from the density distribution $\rho_e$, the photoelectrons BG, due to the scattered light beams, are greatest in number at the central portion of the phosphor screen to which the incident light beam is applied, and lower in number towards the periphery of the phosphor screen. The scattering electrons around the incident light beam lowers the measurement accuracy. As a result, it is difficult to measure a light pulse waveform with high time resolution, since background noises due to the scattered light beams DF are produced before and after the measured light pulse.

The background noises as represented by the density distribution $\rho_e$, is spread over a wide range. As a result, during a non-sweep standby period, while the incident light beam is applied to the photocathode 131 the noise electrons, of density distribution $\rho_e$ will be sampled with high probability. Accordingly, that noise electrons should be eliminated. For this purpose, in the conventional optical waveform observing apparatus, the deflecting voltage V applied by the deflecting circuit 108 is made large in amplitude and high in through rate (voltage/time). This can lower the probability that, during the sweep of the electron beam, the photoelectrons attributable to the scattered light beams are sampled.

As the amplitude of deflecting voltage V is made large, the potential $V_m$ of the deflecting voltage V is large during the non-sweep stand by period. Therefore, even if the incident light beam is applied to the photocathode 131, the signal electrons attributable to the incident light beam are greatly deflected by the deflecting electrode 133, thus reaching a peripheral portion of the phosphor screen 134 that is remote from the central portion. As a result, even if the density distribution $\rho_e$ of the photo electrons due to the scattered light beams is spread over a wide range, the probability that these photoelectrons reach the central portion of phosphor screen 134 is small and, accordingly, their effect on the sampling waveform is eliminated.

With respect to the sampling streak tube 150 shown in FIG. 12, the potential $V_m$ of the deflecting voltage V is made so large that, during the non-sweep period When the electron beam is not undergoing deflection, the electron beam reaches a portion of the sampling electrode 151 that is remote from the slit. Accordingly, in this case also, the sampling waveform is protected from being affected by the photoelectrons caused by the scattered light beams. In practice, the potentials $V_m$ and $-V_m$ of the deflecting voltage V are about +1 KV and −1 KV, respectively.

In the optical waveform observing apparatus in which the waveform of an incident light beam is observed by sampling, an aperture time $\Delta t$, during which the sampling waveform is extracted, is determined by a sweeping velocity $v_t$ at which the electron beam emitted from the photocathode 131 in response to the incident light beam is deflected to sweep across the slit of the sampling electrode, a diameter u of the electron beam, and a slit width w of sampling electrode 151. The aperture time $\Delta t$ corresponds to the time resolution and is represented by the following equation (1):

$$\Delta t = \sqrt{(u^2 + w^2)} / V_t \quad (1)$$

The sweeping velocity $v_t$ can be represented by the following equation (2):

$$v_t = S \times T \quad (2)$$

where S is the deflection sensitivity (cm/V) of the sampling streak tube 150, and T is the through rate (V/sec) of the deflecting voltage.

As is apparent from equation (1) and (2 ), the aperture time $\Delta t$ is decreased as the deflection sensitivity S and/or the through rate T increase, with the result that the time resolution is improved.

However, the conventional optical waveform observing apparatus experiences difficulties when the distance between the pair of deflecting electrodes 133 is decreased for improvement of the deflection sensitivity S: Since the deflecting voltage $V_m$ has been made large in amplitude for the reasons described above, the greatly deflected electron beam will, during the non-sweep period, strike against and be reflected by the deflecting electrodes and the reflected beam will travel to the central portion of the phosphor screen 134. Accordingly, in the conventional optical waveform observing apparatus, it is impossible to greatly reduce the distance between the pair of deflecting electrodes 133.

That is, the possible improvement to the deflection sensitivity S is limited. As a result, it is impossible to obtain a time resolution on the order of several picoseconds and, further, it has been impossible to increase the repetitive frequency of the deflection.

SUMMARY OF THE INVENTION

An object of the invention is to provide an optical waveform observing apparatus in which the sampling waveform is protected from being affected by background noises, the deflection sensitivity can be greatly improved, and high speed repetitive deflection can be carried out.

To achieve the above and other objects and in accordance with the purpose of the invention, as embodied and described herein, the invention comprises a sampling streak tube for use in an optical waveform observing apparatus in which a waveform of an incident light beam having a repetitive frequency is to be observed. The sampling streak tube comprises a photocathode to which the incident light beam is applied and an accelerating electrode for accelerating an electron beam emitted by the photocathode. The accelerating electrode is in the form of a plate having an opening through which the electron beam passes, and deflecting electrodes are provided for deflecting in a predetermined direction the electron beam passing through the accelerating electrode. Sampling means samples the electron beam while being deflected by the deflecting electrodes, and an electron detecting means detects a sampled portion of the electron beam sampled by the sampling means.

In accordance with one embodiment of the invention, the streak tube further includes blanking deflecting electrodes for deflecting the electron beam deflected by the deflecting electrodes in a direction perpendicular to the direction of deflection of the deflecting electrodes.

The accompanying drawings, which are incorporated in and constitute a part of this specification, illustrate embodiments of the invention and together with the description, serve to explain the principles of the invention.

DESCRIPTION OF THE PREFERRED EMBODIMENT

Figure 1:
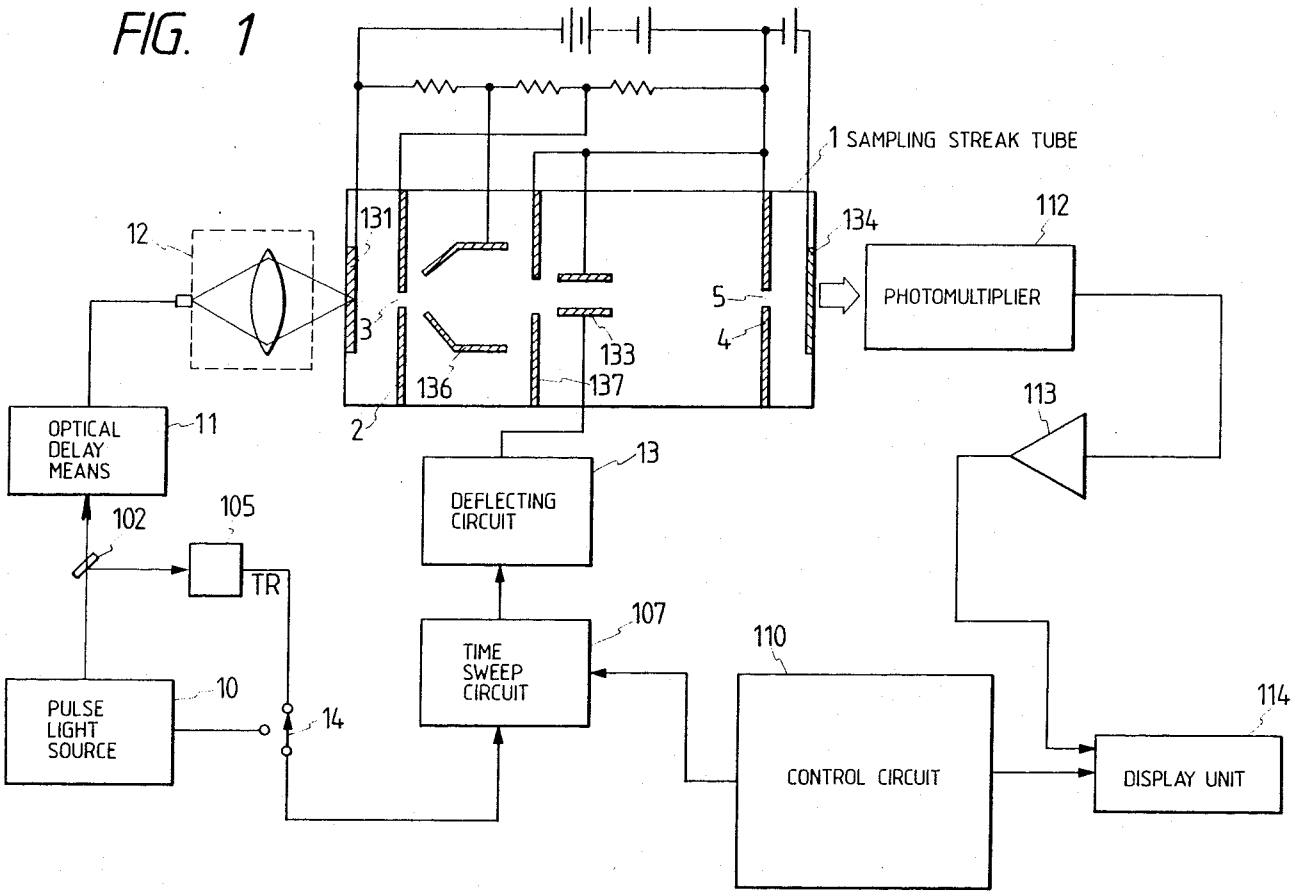
FIG. 1 diagrammatically shows the arrangement of a first example of an optical waveform observing apparatus according to the present invention.

The invention is directed to improved optical waveform observing apparatus in which the waveform of an incident light beam having a repetitive frequency is observed with a sampling streak tube. According to a first aspect of the invention, the sampling streak tube comprises a photocathode to which the incident light beam is applied, an accelerating electrode for accelerating an electron beam emitted from the photocathode deflecting electrodes for deflecting in a predetermined direction the electron beam passing through the accelerating electrode, sampling means for sampling the deflected electron beam, and electron detecting means for detecting the electron beam sampled by the sampling means. The accelerating electrode is preferably in the form of a plate having an opening.

According to a second aspect of the invention, the sampling streak tube further comprises blanking deflecting electrodes for deflecting the electron beam passed through the deflecting electrodes in a direction perpendicular to the direction of deflection of the deflecting electrodes.

In the optical waveform observing apparatus of the present invention, an incident light beam having a constant repetitive frequency is applied to the photocathode of the sampling streak tube, so that an electron beam is emitted from the photocathode. The emitted electron beam is accelerated by the accelerating electrode, and deflected by the deflecting electrodes in a predetermined direction. The deflected electron beam is sampled by the sampling means, and detected by the electron detecting means, so that the waveform of the incident light beam is observed.

In the case of conventional apparatus where a mesh-shaped accelerating electrode is employed for a sampling streak tube, photoelectrons generated by light beams scattered from the accelerating electrode are mixed with the signal electrons to form ground noises spread over a certain range. In order to eliminate this difficulty, the conventional optical waveform observing apparatus is adapted to apply a large amplitude deflecting voltage across the deflecting electrodes so that the background noise associated with an incident light beam applied during the non-sweep period is not sampled by the sampling means. However, because of the large amplitude of the deflecting voltage, it is impossible to reduce the distance between the deflecting electrodes, as a result of which the possible improvement of the deflection sensitivity is limited, and it is impossible to increase the deflecting repetitive frequency.

In accordance with the optical waveform observing apparatus of the present invention, the sampling streak tube comprises a plate-shaped accelerating electrode having an opening, so that the photoelectrons caused by light beams scattered from the accelerating electrode are blocked by the solid portion of the accelerating electrode. Thus, the probability that the photoelectrons are mixed with the signal electrons, to form background noises, is considerably reduced. Accordingly, even when the amplitude of the deflecting voltage applied to the deflecting electrodes is reduced, the background noise associated with the incident light beam applied during the non-sweep period is quite small and, therefore, the probability of the sampling means sampling the background noise is reduced. In consequence, the deflecting voltage applied across the deflecting electrode can be made small in amplitude, and accordingly the distance between the deflecting electrodes can be reduced. As a result, the deflection sensitivity can be improved and the deflecting repetitive frequency can be increased.

In accordance with a further feature of the optical waveform observing apparatus of the present invention, the electron beam passing through the deflecting electrodes is deflected in a direction perpendicular to the direction of deflection of the deflecting electrodes by means of blanking deflecting electrodes arranged behind the deflecting electrodes. For this purpose, a blanking deflecting voltage, synchronous with the deflecting voltage applied across the deflecting electrodes, is applied across the blanking deflecting electrodes during the flyback period provided for the deflecting electrodes. Thus, the electron beam is sampled by the sampling means during the sweep period in which it is deflected by the deflecting electrodes. Then, during the flyback period, the electron beam is deflected in a direction perpendicular to the direction of deflection of the deflecting electrodes by the blanking deflecting electrodes, so that the beam is not sampled by the sampling means.

Figure 10:
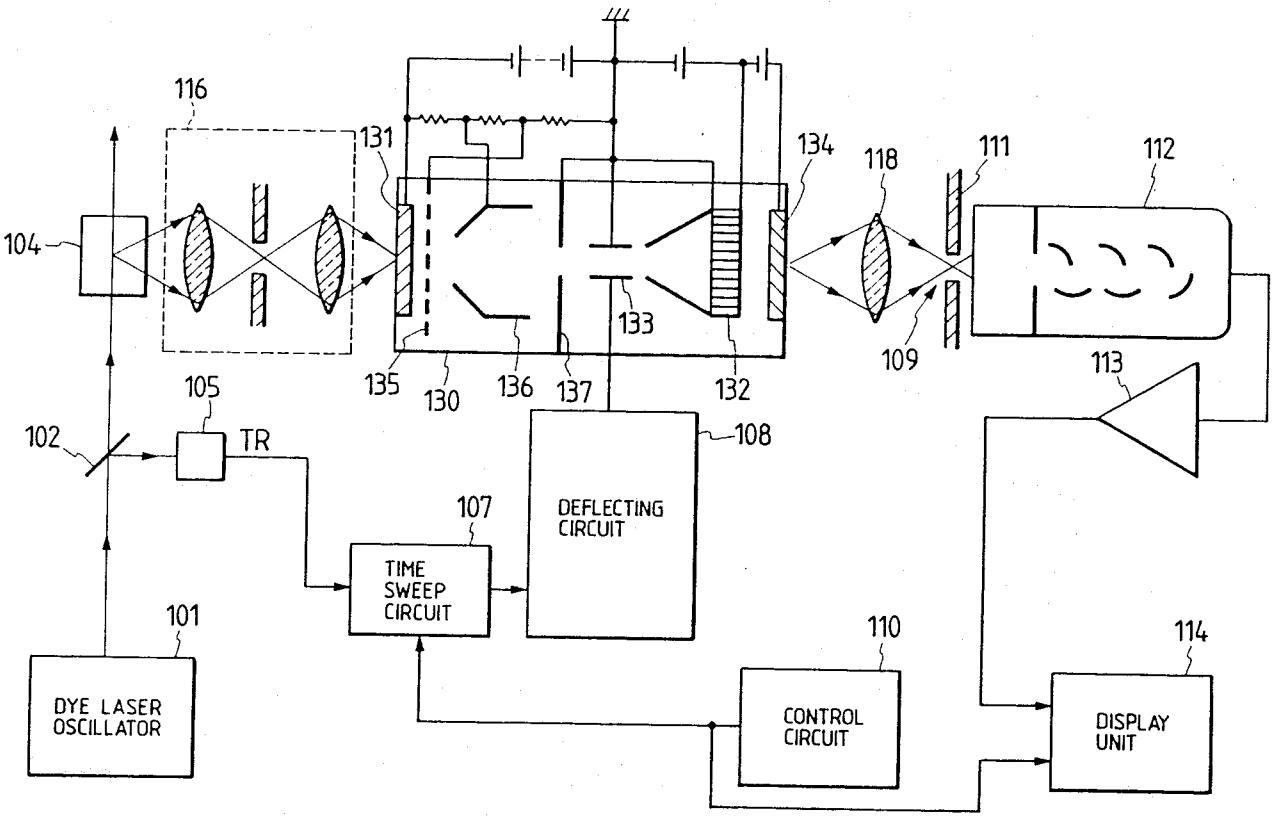
FIG. 10 diagrammatically shows the arrangement of one example of a conventional optical waveform observing apparatus.

FIG. 1 shows the arrangement of a first example of an optical waveform observing apparatus according to the present invention. In FIG. 1, parts corresponding functionally to those already described with reference to FIG. 10 are designated by the same reference numerals, and the preceding description is applicable thereto.

The optical waveform observing apparatus shown in FIG. 1 employs a sampling streak tube 1 that is different from streak tube 130 or sampling streak tube 150 employed in the above-described conventional optical waveform observing apparatus in that its accelerating electrode 2 is not a mesh electrode. Instead, the accelerating electrode is in the form of a plate having an opening 3 of predetermined size substantially at the center. More specifically, the size of the opening 3 is on the order of 30 $\mu$m$\times$3 mm. The opening 3 may be covered with a mesh, if necessary. In sampling streak tube 1, a sampling electrode 4 has a slit 5 similar to that of sampling electrode 151 of the conventional sampling streak tube 150. However, the sampling electrode 4 is not so connected that its potential is always equal to that of the phosphor screen 134. When necessary, a high voltage can be applied across the sampling electrode 4 and the phosphor screen 134 so that the electrons passing through slit 5 are accelerated to reach the phosphor screen 134.

An incident light beam applied to the photocathode 131 of the sampling streak tube 1, is an optical pulse having a repetitive frequency whose waveform is to be observed. More specifically, the incident light beam is outputted by a pulsed light source 10, and is applied through a beam splitter 102, an optical delay means 11, and an input optical system 12 to the photocathode 131 of the sampling streak tube 1.

In similar fashion to the beam splitter in the conventional optical waveform observing apparatus, the beam splitter 102 splits the incident light beam outputted by the pulsed light source 10 into two parts, one of which is applied to the photodiode 105, where it is converted into an electrical trigger signal TR. Also, as in the conventional apparatus, the electrical trigger signal TR is applied to the time sweep circuit 107, where it is converted into a deflecting trigger signal that is gradually delayed. The deflecting trigger signal is applied to a deflecting circuit 13.

Photodiode 105 is used to form the electrical trigger signal TR by photo-electric conversion. However, a drive signal for the pulsed light source 10 may be employed as the electrical trigger signal TR by operating a switch 14.

Figure 2A:
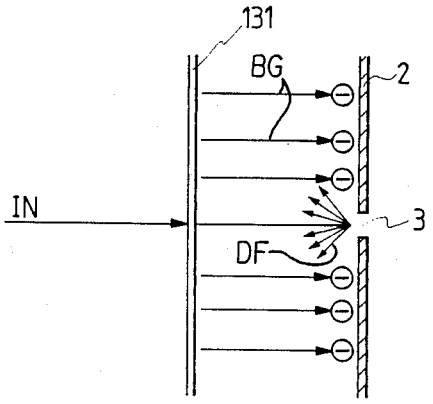
FIGS. 2(*a*) and 2(*b*) respectively illustrate the blocking of photoelectrons from scattered light beams by a plate-shaped accelerating electrode having an opening and an electron density distribution diagram for a sampling electrode in the case where the plate-shaped accelerating electrode is used.
Figure 2B:
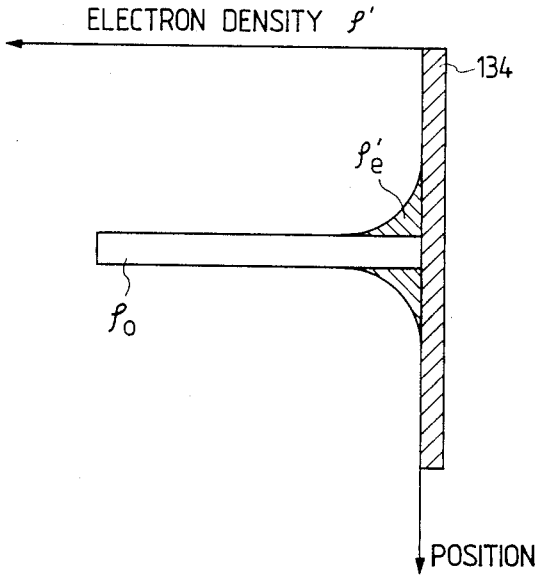
Figure 11:
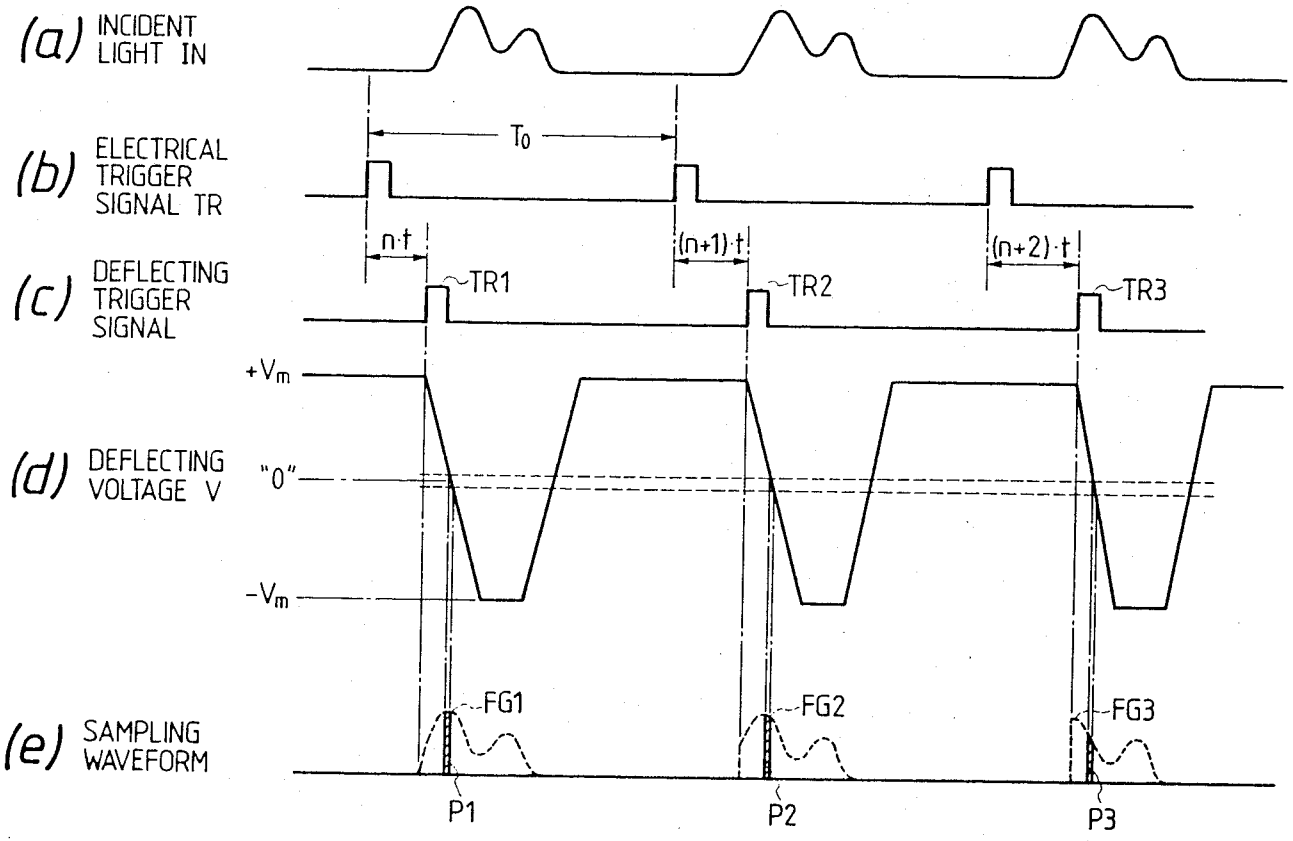
FIG. 11 (*a*) through (*e*) are time charts respectively showing an incident light beam IN, an electrical trigger signal TR, a deflecting trigger signal, a deflecting voltage V, and a sampling waveform.
Figure 13A:
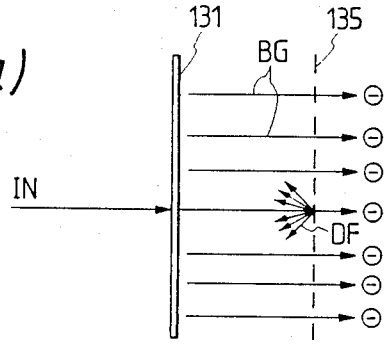
FIG. 13 (*a*) and (*b*) respectively illustrate the blocking of photoelectrons from scattered light beams in the case where a mesh-type accelerating electrode is employed and an electron density distribution diagram for a sampling electrode in the case where the mesh-type electrode is used.
Figure 13B:
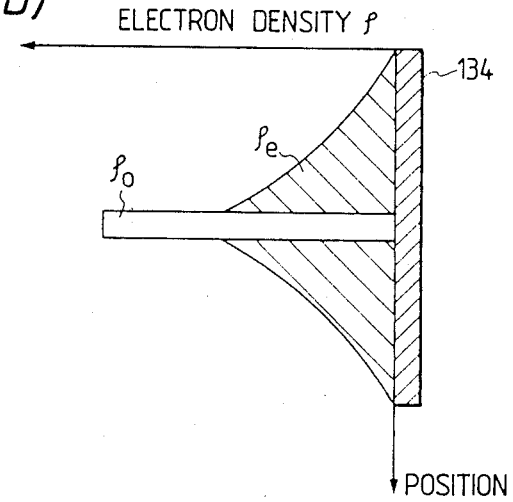

Also in similar fashion to the conventional optical waveform observing apparatus, the optical waveform observing apparatus of the invention operates according to the time charts shown in parts (a) through (e) of FIG. 11. However, it should be noted that in the apparatus shown in FIG. 1, the accelerating electrode 2 of the sampling streak tube 1 is in the form of a plate and has only one opening 3 substantially at the center as was described above and, therefore, as shown in part (a) of FIG. 2, the photoelectrons BG resulting from the scattered light beam DF are intercepted by the solid part of the accelerating electrode 2 and do not propagate to the sampling electrode 4. Accordingly, the electron density $\rho'$ of the electron beam reaching sampling electrode 4 is as shown in part (b) of FIG. 2. As is apparent from a comparison of part (b) of FIG. 2 with part (b) of FIG. 13, the density distribution $\rho_e'$ of the photoelectrons caused by the scattered light beam is very small. Thus, the use of the plate-shaped accelerating electrode 2 can effectively prevent the effects of the photoelectrons attributed to the scattered light beams, i.e., it can minimize the background noise.

In sampling streak tube 1, because of the employment of the plate-shaped accelerating electrode 2, it is unnecessary to substantially increase the amplitude of the deflecting voltage applied across the deflecting electrodes. In the time chart of part (d) of FIG. 11, the potentials $V_m$ and $-V_m$ of the deflecting voltage can be much smaller than those in the conventional optical waveform observing apparatus, for example +32.5V and −32.5V, respectively. Thus, in the case of observing apparatus so designed that the deflecting voltage V can be made low as described above, the electron beam is applied, during the non-sweep period, to a part of the sampling electrode 4 that is relatively close to slit 5 when compared with operation of the conventional apparatus. However, the photoelectrons caused by the scattered light beams scarcely reach the sampling electrode 4. Even if these photoelectrons reach the sampling electrode 4, the density distribution $\rho_e'$ thereof is small. For example, with a mesh-like accelerating electrode, the rate of arrival of photoelectrons due to scattered light beams is on the order of $10^{-3}$ of that of the normal signal electrons. In contrast, with the accelerating electrode 2 provided as described above, the rate of arrival of photoelectrons due to scattered light beams is on the order of $10^{-6}$ of that of the normal signal electrons, so that they scarcely reach the sampling electrode. Therefore, the probability that photoelectrons due to scattered light beams pass through the slit 5 is on the order of from $10^{-3}$ to $10^{-6}$ of the probability that the signal electrons pass through slit 5. Accordingly, the sampling waveform can be observed with high accuracy since it is free from background noises.

In addition, in accordance with the observing apparatus of the invention, the amplitude of the deflecting voltage V can be made small. Further, if the linearity of the ramp of the waveform of the deflecting voltage deflecting the electron beam is degraded, the accuracy of observation of the sampling waveform extracted is not adversely affected since the deflecting voltage waveform that allows the electron beam to pass through the slit 5 is equal for every repetitive period.

As was described above, with respect to the first example of the optical waveform observing apparatus of the present invention, the deflecting voltage applied across the deflecting electrodes 133 in the sampling streak tube 1 can be made small in amplitude. Therefore, even if the distance between th deflecting electrodes 133 is made considerably smaller, the apparatus is free from the difficulty that, during the non-sweep period, the deflected electron beam strikes against the deflecting electrodes 133. As a result, the deflection sensitivity is doubled when compared with that of the conventional apparatus, so that the time resolution is improved. A time resolution on the order of several picoseconds can be obtained with a potential $V_m$ of approximately 65V. In order to obtain a time resolution on that order, the conventional apparatus requires a voltage of from several hundreds to several thousands of volts.

In view of the fact that the deflecting voltage amplitude can be made small, the deflecting circuit 13 can produce a deflecting voltage having a high repetitive frequency on the order of 4 MHz. In the conventional optical waveform observing apparatus, the deflecting circuit 108 employs an element such as an avalanche transistor or triode, because a deflecting voltage large in amplitude must be produced. However, the deflecting circuit 108 using such an element can only produce a deflecting voltage having a low repetitive frequency on the order of, at most, 1 KHz. Therefore, with the conventional apparatus, an optical phenomenon with a high repetitive frequency on the order of 100 MHz, such as may be provided by a mode synchronization dye laser or semiconductor laser, cannot be detected with high efficiency.

The above-described difficulty associated with a low repetitive frequency may be overcome by allowing deflecting circuit 108 to use an LC resonance circuit to form a high-speed high-voltage sine-wave deflecting voltage on the order of 100 MHz. Using this method, an optical phenomenon with a high repetitive frequency can be efficiently observed with a high repetitive deflecting voltage synchronous with it. However, because of the use of the LC resonance circuit, the repetitive frequency of the optical phenomenon to be observed is limited, so that the measurement is also limited. Further, the use of the LC circuit is disadvantageous in that, when the repetitive frequency or phase of an optical phenomenon under measurement changes during observation, the accuracy of measurement is greatly reduced. As is apparent from the above description, in the conventional optical wave observing apparatus, it is essential to use a deflecting voltage large in amplitude, and therefore it is impossible to effectively produce a deflecting voltage high in repetitive frequency. However, the provision of such a high repetitive frequency deflecting voltage is necessary especially to avoid a reduction in the utilization factor of the signal by the sampling system during a high-speed sampling operation.

In the above-described first example of the optical waveform observing apparatus according to the invention, the deflecting voltage amplitude can be small, and therefore a switching element or drive element in the deflecting circuit 13 can have a relatively low withstand voltage. Accordingly, the deflecting circuit 13 can be constructed using high frequency transistors or step recovery diodes, so that high repetitive deflection frequency, e.g., on the order of 4 MHz, can readily be achieved. While the repetitive frequency of 4 MHz is lower than a repetitive frequency on the order of 100 MHz, as can be provided by an LC resonance circuit, the measuring frequency of the deflecting circuit is advantageously not fixed, so that it can be used as a general purpose measuring instrument.

For example, when the slit width w of slit 5 of sampling electrode 4 is set to 60 $\mu$m, and the diameter u of the electron beam is set to 80 $\mu$m, then, in order to provide an aperture time $\Delta t$ of 10 pico-seconds, the sweep velocity $v_t$ should be on the order of 10 mm/nano-second according to equation (1). When the deflection sensitivity S of sampling streak tube 1 is set to 0.1 mm/V, the through rate T of the deflecting voltage required for an aperture time $\Delta t$ of 10 pico-seconds is 100 V/nano-second according to equation (2). Such a through rate T can be readily provided by a deflecting circuit made up of high-frequency transistors or step recovery diodes.

As was described above, in the first example of the optical wave observing apparatus according to the present invention, the provision of the plate-shaped accelerating electrode with opening 3 allows a reduction in the amplitude of the deflecting voltage. As a result, the distance between the deflecting electrodes 133 can be reduced to substantially double the deflection sensitivity S, and to realize a highly repetitive deflection on the order of 4 MHz.

In accordance with the first example of the apparatus of the invention, during the sweep period, the ramp characteristic of the deflecting voltage waveform can be changed to provide a plurality of aperture times $\Delta t$. When, in the sampling system of the present invention, the aperture time $\Delta t$ is reduced, a high time resolution can be obtained. However, the sampling waveform extraction time is correspondingly decreased In the measurement of a slow optical phenomenon, it is unnecessary that the time resolution be very high. Accordingly, during the sweep period, the ramp of the deflecting voltage waveform should be decreased to increase the aperture time $\Delta t$, to thereby increase the sampling waveform detecting efficiency. In this case, a weak optical phenomenon can be observed with a high S/N ratio. The ramp of the deflecting voltage waveform can be changed with a mirror integration circuit.

Figure 3:
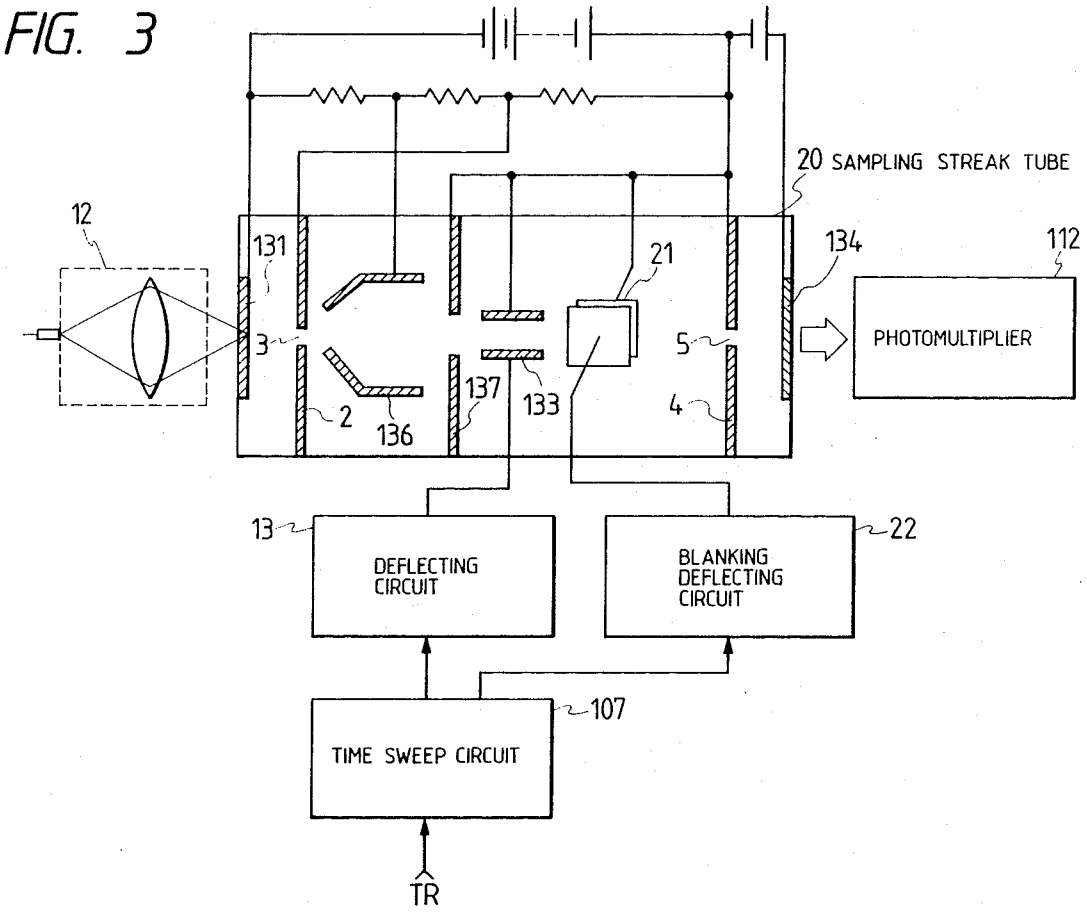
FIG. 3 diagrammatically shows the arrangement of a second example of the optical waveform observing apparatus according to the present invention.
Figure 4:
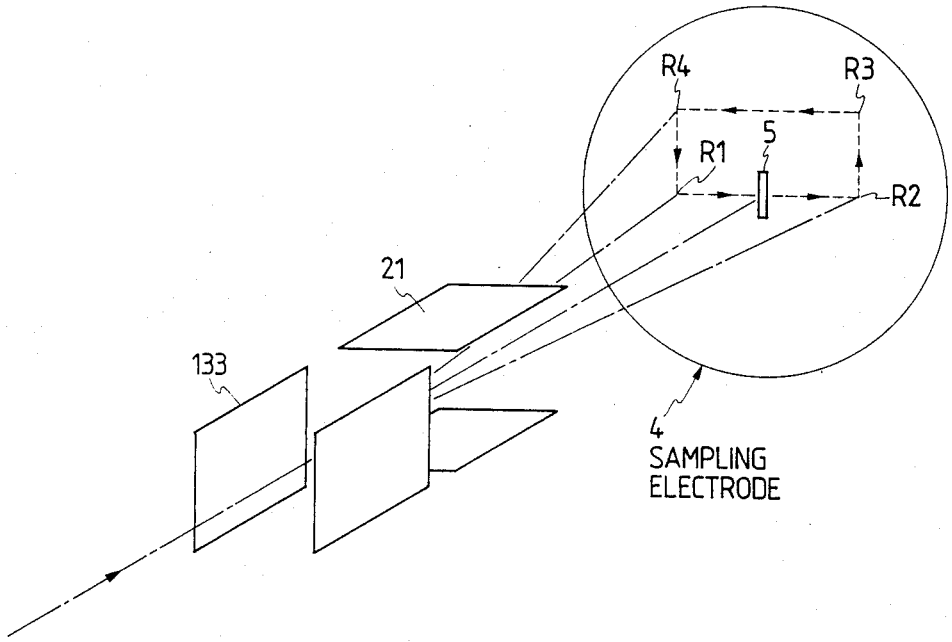
FIG. 4 illustrates the locus of an electron beam on a sampling electrode which is subjected to blanking deflection.

FIG. 3 shows the arrangement of part of a second example of the optical waveform observing apparatus according to the present invention. In the optical waveform observing apparatus of FIG. 3, a sampling streak tube 20 has a plate-shaped accelerating electrode 2 with an opening 3, similar to that provided in the above-described sampling streak tube 1 shown in FIG. 1, and blanking electrodes 21 between deflecting electrodes 133 and sampling electrode 4. Blanking electrodes 21 are provided for deflecting the electron beam in a direction perpendicular to the direction of deflection of the deflecting electrodes, as shown in FIG. 4, so that after the sampling electrode 4 is swept with the electron beam from R1 to R2 during the period of deflection of the deflecting electrodes 133, the electron beam cannot sweep across the slit 5 of the sampling electrode 4 during the flyback period of the deflecting electrodes 133. In other words, during the period of flyback of the deflecting electrodes 133, a blanking deflecting voltage applied across the blanking electrodes 21 constrains the electron beam to sweep from R3 to R4 on sampling electrode 4 so that the beam cannot cross the slit 5 in the sampling electrode 4, this function being described move fully below.

The blanking deflecting voltage applied across the blanking electrodes 21 is provided by a blanking deflecting circuit 22, which receives the same deflection trigger signal from the time sweep circuit 107 as that applied to deflecting circuit 13.

Figure 5:
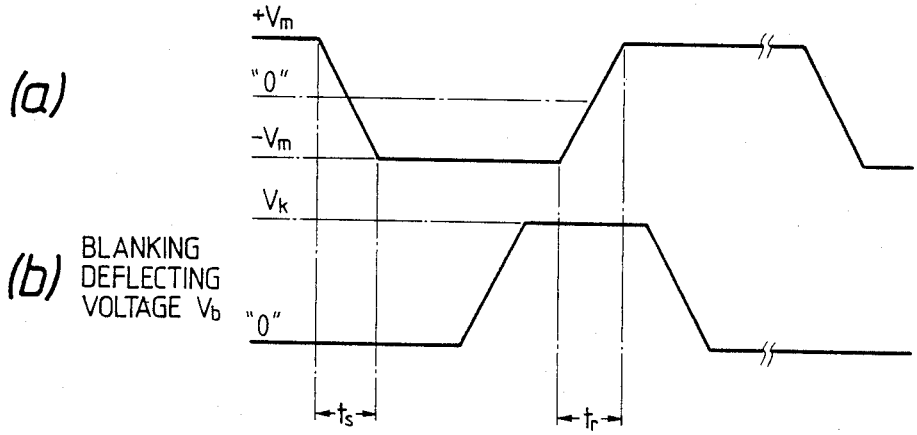
FIGS. 5 (*a*) and (*b*) are time charts respectively showing a deflecting voltage and a blanking deflecting voltage.

Parts (a) and (b) of FIG. 5 are time charts showing the deflecting voltage provided by the deflecting circuit 13 and the blanking deflecting voltage outputted by the blanking deflecting circuit 22, respectively. As is seen from parts (a) and (b) of FIG. 5, during the period of sweep $t_s$ in which the deflecting voltage V drops from $V_m$ to $-V_m$, the blanking deflecting voltage $V_b$ is maintained at zero (0) volts, and the electron beam deflected by the deflecting electrodes 133 is not subjected to blanking deflection. As a result, the electron beam crosses the slit 5 while sweeping the sampling electrode from R1 to R2, as shown in FIG. 4, and is thereby sampled. When the deflecting voltage V is at $-V_m$, the electron beam is located at R2 on the sampling electrode. When, under this condition, the blanking deflecting voltage $V_b$ is raised from zero (0) to $+V_k$, the electron beam sweeps sampling electrode 4 from R2 to R3. The blanking deflecting voltage $V_b$ is maintained at $+V_k$ during the flyback period tr while deflecting voltage V changes from $-V_m$ to $+V_m$. Therefore, during the flyback period $t_r$, the electron beam sweeps the sampling electrode 4 from R3 to R4, and will not sweep across the slit. As a result, the beam is not sampled. After the flyback period $t_r$, the electron beam is located at R4 on sampling electrode 4, and is returned to R1 when the blanking deflecting voltage Vb becomes zero (0) volts again.

Thus, the application of the blanking deflecting voltage $V_b$ to the blanking deflecting electrodes 21 minimizes the noise due to light incident to the streak tube during the flyback period $t_r$, and allows waveform observation with a high S/N ratio.

In the above-described second example of the optical waveform observing apparatus of the present invention, the blanking deflecting voltage $V_b$ has a trapezoid shaped waveform synchronous with the deflecting voltage V so that the electron beam can describe a rectangular locus on the sampling electrode 4. However, the invention is not so limited. All that is required for the waveform of the blanking deflecting voltage $V_b$ is to cause the electron beam to sweep the sampling electrode 4 during the flyback period in a manner that does not sweep the slit 5 of the sampling electrode. For example, the electron beam can sweep the sampling electrode in such a manner as to describe an elliptical locus thereon.

Figure 12:
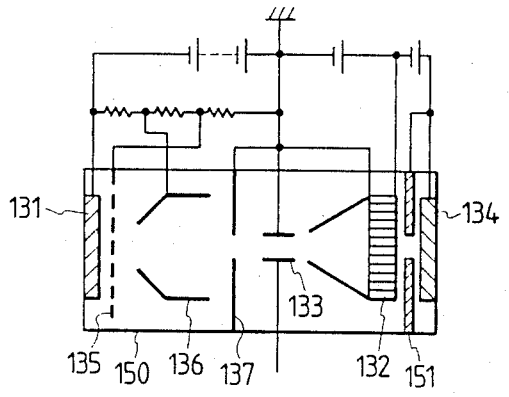
FIG. 12 diagrammatically shows the structure of a conventional sampling streak tube.

In the sampling streak tubes 1 and 20 of the first and second examples of the optical waveform observing apparatus according to the present invention, a high voltage on the order of +5 KV can be applied across the sampling electrode 4 and phosphor screen 134, with the result that the light emission efficiency of the phosphor screen 134 can be improved to about three times as high as that of the sampling streak tube 150 shown in FIG. 12.

Figure 6A:
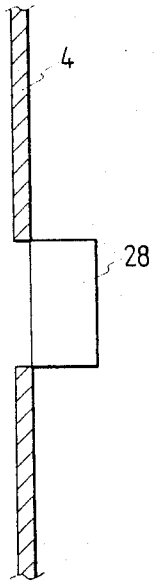
FIGS. 6 (*a*) and (*b*) respectively show examples of a micro channel plate provided behind the sampling electrode.
Figure 6B:
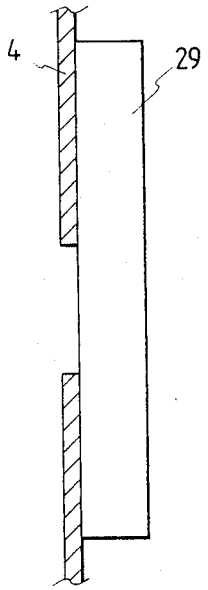
Figure 7:
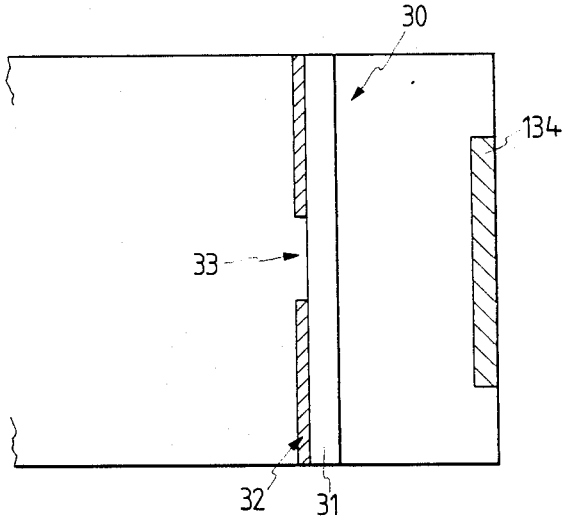
FIG. 7 illustrates sampling means having a microchannel plate with a shielding film.

Further, in the sampling streak tubes 1 and 20 of the first and second examples of the apparatus according to the present invention, a microchannel plate 28 (or 29) can be provided behind the sampling electrode 4 as shown in part (a) (or (b)) of FIG. 6, or the sampling electrode may be designed as shown in FIG. 7.

The structure of a sampling electrode 30 shown in FIG. 7 is such that the electron beam is applied only through a central portion 33 of an accelerating electrode 32 to a microchannel plate 31. In this case, when compared with the streak tubes shown in FIGS. 1 and 3 which allow the electron beam to pass through the slit 5 as it is, the electron beam can be passed through central portion 33 of microchannel plate 31 in a multiplication mode.

In the above-described embodiments of the invention, the phosphor screen 134 operates as an electron detector. However, an electron multiplier or "channeltron" (not shown) may be employed instead of the phosphor screen 134, so that the electrons sampled by the sampling electrode are directly multiplied. Further, an electron bombarding implantation type semiconductor element (not shown) such as a silicon cell may be provided instead of the phosphor screen 134, so that the electrons sampled, after being subjected to electron multiplication, are detected. In these cases, the photomultiplier 112 may be eliminated.

Further, the phosphor screen 134 may be replaced by a scintillator (not shown). In this case, the scintillation light emission caused by the collision of the sample electrons would be detected with the photomultiplier 112.

In the above-described embodiments of the invention, only one sampling streak tube is employed. However, these embodiments may be modified by providing a plurality of the above-described sampling streak tubes juxtaposed with one another, the electron beams therein being simultaneously deflected with one or a plurality of deflecting circuits respectively provided therefor, so that multiple channels of optical waveforms may be observed at the same time.

Figure 8:
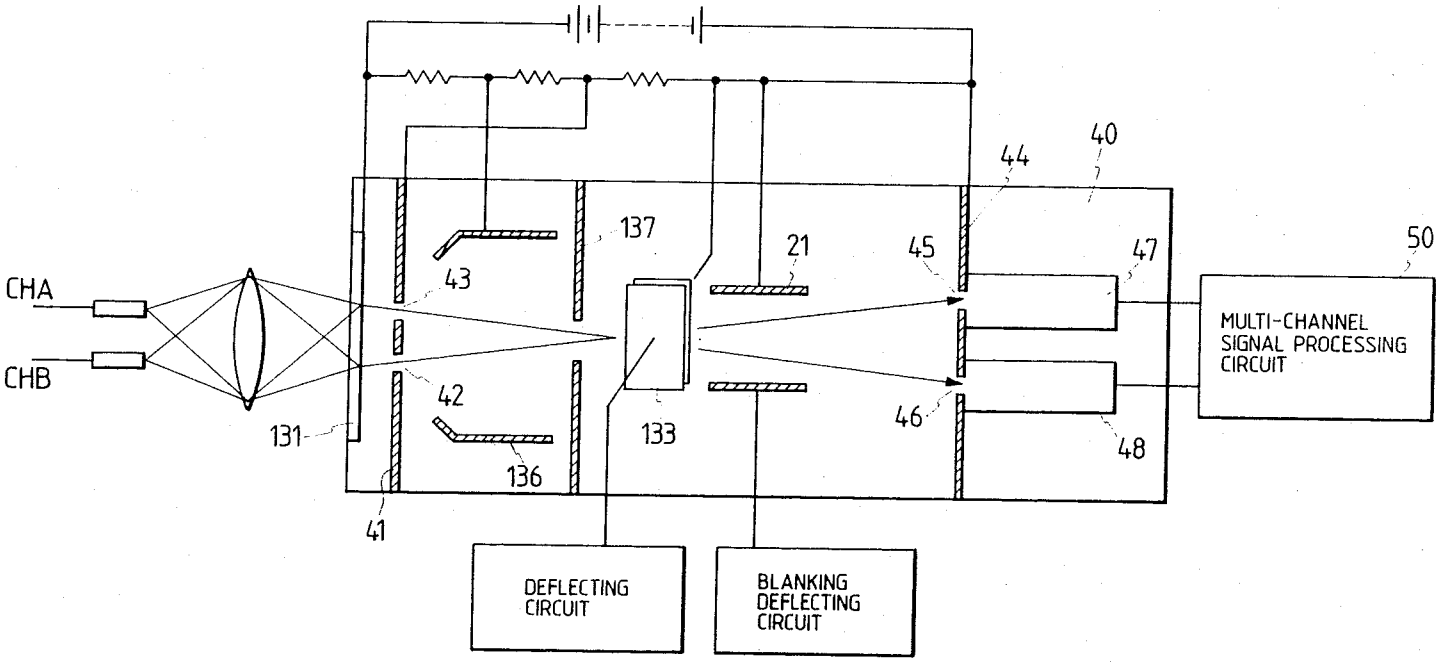
FIG. 8 diagrammatically shows the arrangement of a multi-channel type optical waveform observing apparatus according to the present invention.

Thus, the above-described embodiments may be modified as shown in FIG. 8. In accordance with the embodiment illustrated in that figure, a multichannel sampling streak tube 40 may be employed for simultaneous observation of multiple channels of incident light beams. Multichannel sampling streak tube 40 comprises an accelerating electrode 41 having a plurality of slits (42 and 43 in the case of FIG. 8), a sampling electrode 44 having slits (45 and 46 in the case of FIG. 8) the number or which is equal to that of the slits of the accelerating electrode 41, and electron multipliers (47 and 48 in the case of FIG. 8) respectively provided behind the slits of the sampling electrode 44. Thus, FIG. 8 shows a multichannel type optical waveform observing apparatus.

The apparatus shown in FIG. 8 operates as follows: When multiple channels of incident light beams CHA and CHB are simultaneously applied to photocathode 131 of the multichannel sampling streak tube 40, the photocathode 131 emits electron beams corresponding respectively to the incident light beams. The electron beams thus emitted are applied through the respective slits 42 and 43 of the accelerating electrode 41, the aperture electrode 137, the deflecting electrodes 133, the blanking electrodes 21 and the respective slits 45 and 46 of the sampling electrode 44, to the respective electron multipliers 47 and 48, where they are subjected to electron multiplication. The outputs of the electron multipliers 47 and 48 are applied to a multichannel signal processing circuit 50, where they are suitably processed.

Figure 9:
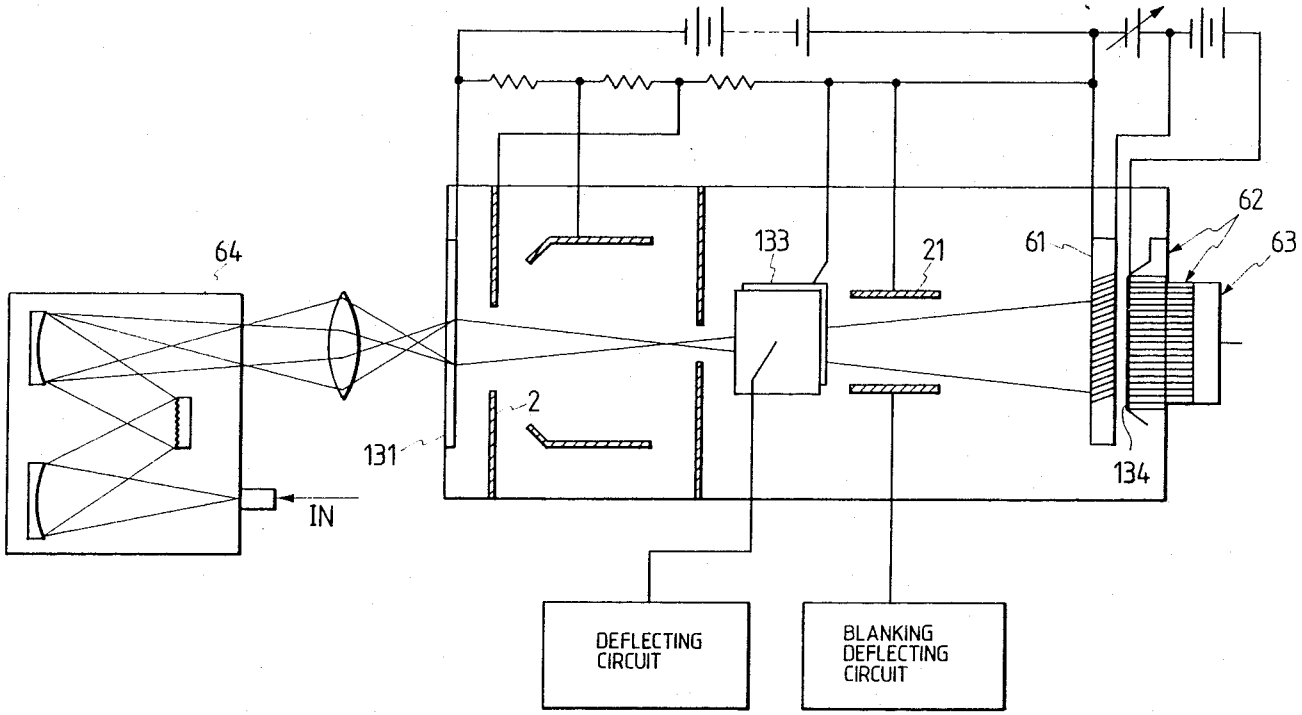
FIG. 9 diagrammatically shows the arrangement of an optical waveform observing apparatus having a linear image sensor according to the present invention.

Further, the above-described embodiments of the invention may be modified as shown in FIG. 9. There, instead of the sampling electrode, a microchannel plate 61 is employed in which a plurality of channels are arranged in the form of a slit that is long in a direction perpendicular to the direction of deflection induced by the deflecting electrodes 133. Phosphor screen 134 is provided immediately behind the microchannel plate 61 and light emitted from the phosphor screen 134 is applied through fiber plates 62 to a linear image sensor 63. Linear image sensor 63 operates to read the data of the spatial incident light beam by scanning in a direction perpendicular to the direction of deflection of the deflecting electrodes 133.

The optical waveform observing apparatus shown in FIG. 9 is applicable, for example, to the case where multiple spectra provided by a spectroscope 64 are applied to photocathode 131 so that their one-dimensional data may be read with high accuracy.

As was described above, in the optical waveform observing apparatus of the present invention, the sampling streak tube has a plate shaped accelerating electrode with an opening, and therefore the deflecting voltage applied across the deflecting electrodes can be small in amplitude and, accordingly the distance between the deflecting electrodes can be short. As a result, the deflection sensitivity is improved and the deflecting repetitive frequency is increased, whereby the waveform of an optical phenomenon of high repetitive frequency can be accurately observed with high time resolution.

Further, the blanking deflecting electrodes are provided according to the invention to prevent the sampling of the electron beam during the flyback period of the deflecting electrodes, as a result of which observations can be made with greater accuracy.

It is intended that the present invention cover the modifications and the variations of this invention provided they come within the scope of the appended claims and their equivalents.

What is claimed is:

1. A sampling streak tube for use in an optical waveform observing apparatus in which a waveform of an incident light beam having a repetitive frequency is to be observed, the sampling streak tube comprising:

a photocathode to which the incident light beam is applied to emit a corresponding electron beam;

an accelerating electrode for accelerating said electron beam emitted by said photocathode, said accelerating electrode being in the form of a plate having an opening through which said electron beam passes;

deflecting electrodes for deflecting in a predetermined direction said electron beam passed through said accelerating electrode;

sampling means for sampling said electron beam while being deflected by said deflecting electrodes; and electron detecting means for detecting a sampled portion of said electron beam sampled by said sampling means.

2. The sampling streak tube of claim 1, wherein said opening in said accelerating electrode is on the order of 30 $\mu m \times 3$ mm.

3. The sampling streak tube of claim 1, wherein said sampling means is a sampling electrode having an opening.

4. The sampling streak tube of claim 1, wherein said sampling means comprises:

a sampling electrode with an opening; and a microchannel plate positioned behind said sampling electrode to receive the sampled portion of said electron beam that passes through said sampling electrode opening.

5. The sampling streak tube of claim 1, wherein said sampling means comprises a microchannel plate including a predetermined portion to which said electron beam is selectively applied for passage therethrough and electron multiplication thereby.

6. The sampling streak of claim 1, wherein said electron detecting means comprises a phosphor screen.

7. The sampling streak tube of claim 1, wherein said electron detecting means comprises an electron multiplier that subjects the sampled portion of said electron beam to electron multiplication.

8. The sampling streak tube of claim 1, wherein said electron detecting means comprises a channeltron.

9. The sampling steak tube of claim 1, wherein said electron detecting means comprises an electron bombarding type semiconductor element.

10. The sampling streak tube of claim 1, wherein said electron detecting means comprises a scintillator.

11. The sampling streak tube of claim 1, wherein said accelerating electrode has a plurality of openings;

said sampling means has a plurality of sampling parts equal in number to the number of openings in said accelerating electrode; and said electron detecting means has independent electron multipliers for respectively subjecting to electron multiplication electron beams passed through said sampling parts of said sampling means, said electron multipliers being equal in number to the number of said sampling parts whereby multiple channels of incident light beams respectively applied to said photocathode are observed simultaneously.

12. The sampling streak tube of claim 1, wherein said sampling means is a microchannel plate in which a plurality of channels are arranged to form a slit elongated in a direction perpendicular to the predetermined deflecting direction of said deflecting electrodes;

said electron detecting means being a phosphor screen disposed immediately behind said microchannel plate;

said sampling streak tube further including a linear image sensor; and a fiber plate through which light emitted from said phosphor screen is introduced to said linear image sensor.

13. The sampling streak tube of claim 1, further including means for applying an accelerating voltage between said sampling means and said electron detecting means to accelerate the sampled portion of said electron beam.

14. A sampling streak tube for use in an optical waveform observing apparatus in which a waveform of an incident light beam having a repetitive frequency is observed, said sampling streak tube comprising:

a photocathode for receiving said incident light beam and for emitting a corresponding electron beam;

an accelerating electrode for accelerating said electron beam emitted from said photocathode, said accelerating electrode being in the form of a plate having an opening through which said electron beam passes;

deflecting electrodes for defining in a predetermined direction said electron beam passed through said accelerating electrode;

blanking deflecting electrodes for deflecting said electron beam deflected by said deflecting electrodes in a direction perpendicular to the direction of deflection of said deflecting electrodes;

sampling means for sampling said electron beam deflected by said deflecting electrodes; and electron deflecting means for detecting said electron beam sampled by said sampling means.

15. The sampling streak tube of claim 14, further including means for applying a blanking deflecting voltage across said blanking electrodes synchronously with a deflecting voltage applied across said deflecting electrodes, said blanking voltage being applied during a flyback period provided for said deflecting electrodes.

* * * * *